United States Patent [19]

Pyle

[11] Patent Number: 5,027,794

[45] Date of Patent: Jul. 2, 1991

[54] EXERCISE DEVICE

[75] Inventor: Gerald T. Pyle, Shelton, Wash.

[73] Assignee: PDLX Company, Shelton, Wash.

[21] Appl. No.: 481,886

[22] Filed: Feb. 20, 1990

[51] Int. Cl.[5] ..... A61H 1/02; A63B 21/005

[52] U.S. Cl. ..... 128/25 R; 272/73; 272/96; 272/129; 272/132; 128/25 B

[58] Field of Search ..... 272/70, 73, 72, 96, 272/129, 900, 131, 132, 133, 134; 128/25 R, 25 B

[56] References Cited

U.S. PATENT DOCUMENTS 3,964,742 6/1976 Carnielli ..... 272/73

*Primary Examiner*—Robert Bahr

*Attorney, Agent, or Firm*—Christensen, O'Connor, Johnson & Kindness

[57] ABSTRACT

An exercise device for working one's arms or legs is disclosed. The exercise device includes a crank assembly with a stationary frame and a rotating crankshaft attached thereto. The crankshaft is fitted with either handgrips or shoe plates to which an individual's arms or feet may be attached so that the individual's limbs may be worked. A motor unit with a drive motor is selectively suspended from the crank assembly frame. Complementary couplers on the crankshaft and motor unit interlock when the motor unit is attached to the crank assembly so that power from the drive motor can rotate the crankshaft. The exercise device can thus be used by individuals capable of manually rotating the crankshaft, or by individuals who would benefit from having their limbs worked but require assistance in rotating the crankshaft. The handgrips and shoe plates are each provided with a bearing assembly that allows them to rotate about the crankshaft and which is releasable so that the handgrips and shoe plates can be interchanged as may be desired.

25 Claims, 1 Drawing Sheet

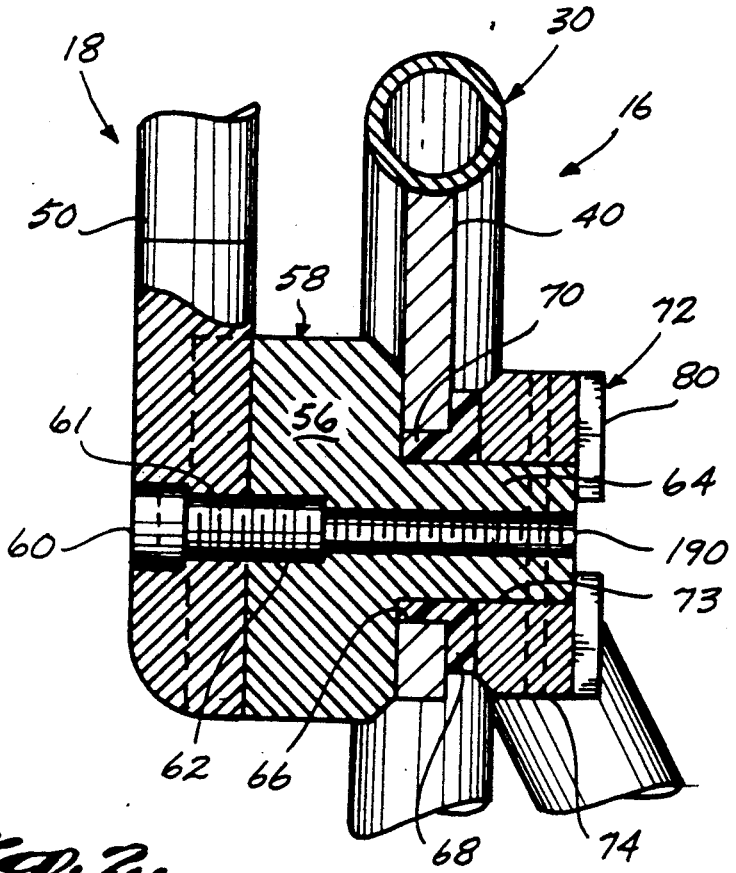
Fig. 2.
Fig. 3.
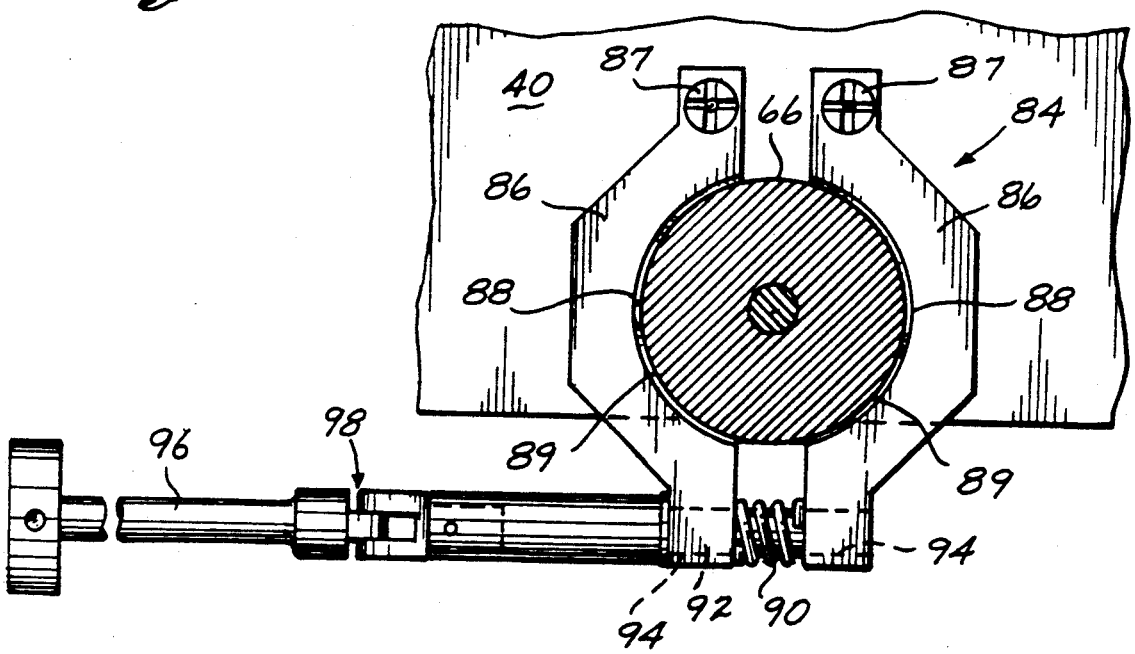

EXERCISE DEVICE

FIELD OF THE INVENTION

This invention relates generally to an exercise device, and, more specifically, to a portable exercise device useful for working the arms and legs of bedridden individuals.

BACKGROUND OF THE INVENTION

Therapeutic exercise devices are frequently used by convalescing and disabled individuals to exercise muscles and limbs that would not otherwise receive significant use. This exercise is important because it prevents the muscles and other tissues from atrophying and the cartilage around the bones from hardening as would otherwise happen when limbs fall into disuse. Many exercise devices include a rotating shaft with hand or foot holds. The shaft is either manually or mechanically rotated. Manual exercise devices are rotated by the user's muscle power. These devices are used by individuals with sufficient body strength and control to turn the shaft for a sufficient amount of time so that the individuals receive a sufficient amount of exercise. Mechanical exercise devices are driven by motor systems connected to their shafts. These devices are used by individuals who lack sufficient strength or body control to turn the shaft manually but who would still otherwise benefit from this type of therapeutic motion.

Many current therapeutic exercise devices are of minimal versatility, which limits their usefulness. For example, most exercise devices are either exclusively manually or motor operated and cannot be switched between drive modes. Consequently, individuals who would benefit by a combination of manual and mechanically assisted therapy need to be provided with two exercise devices. The cost of providing near-duplicate equipment can be an expensive proposition. This is especially true for homebound individuals who may be of limited means.

Still another limitation of many current exercise devices is that they are not readily adapted for use by bedridden individuals. While there have been some exercise devices for bed use developed, many of them must be clamped to a bed frame prior to use. Thus, whenever an individual desires use of the device, a caregiver must typically mount the device and then disconnect it each time its use is desired. In a hospital or convalescent facility with a large number of individuals desiring use of the exercise devices, significant amounts of caregiver time may be required setting up and taking down the devices used by the patients. Furthermore, some bed-mountable exercise devices can only be properly used when attached to an appropriate support structure. An individual cannot simply place these devices on the floor or other surface where their use may sometimes be more convenient or comfortable. Moreover, many homebound individuals may not have, or may not desire, the type of bed frames to which these devices must be mounted.

Motor driven exercise devices have their own disadvantages. These devices tend to be rather bulky and difficult to set up. This limits their use by homebound individuals. Moreover, their size and complexity make it difficult for a traveling caregiver such as a physical therapist to take the device from patient to patient. Another disadvantage of motor driven exercise devices is that the few available for bedridden individuals are difficult to set up and take down. This contributes to the problems associated with providing a bedridden individual with the exercise required.

SUMMARY OF THE INVENTION

This invention comprises providing a portable exercise device that can be either manually or mechanically driven. The exercise device of this invention is compact, easy to assemble and take down, and well suited for use by bedridden individuals.

The exercise device of this invention includes a crank assembly comprising a frame to which a rotating crankshaft is attached. Handgrips or shoe plates are attached to the crankshaft so that an individual may exercise arms or legs as may be desired. The exercise device also includes a motor unit having a housing which can be selectively suspended from the crank assembly frame. The crankshaft and motor unit are provided with couplers that interlock when the motor is mounted to the crank assembly frame. Power from the motor unit is transmitted through the couplers to rotate the crankshaft.

An individual can use the exercise device of the invention to work his limbs by manually rotating the crankshaft. Alternatively, the motor unit can be mounted to the crank assembly frame to provide power assistance for exercising the individual's limbs. Thus, depending on the individual's current physical condition, this device can be used to either to manually or mechanically exercise the individual's arms or legs.

The crank assembly and motor unit of this exercise device are both relatively compact units. The crank assembly is a lightweight structure that is dimensioned to fit across a bed. Thus, it is a relatively effortless task to place the assembly at the head or foot of a bed so that a bedridden individual's arms or legs can be exercised. The motor unit housing is compact, hand carryable, and is mounted to the crank assembly by simply suspending it from the crank assembly frame. Thus, should an individual's exercise regime require mechanized assistance, the motor unit can be attached to the crank assembly with a minimal amount of effort.

BRIEF DESCRIPTION OF THE DRAWINGS

This invention is defined with particularity in the appended claims. The advantages of this invention may be understood by referring to the following detailed description in which:

FIG. 2 is a cross-sectional view illustrating how one end of the crankshaft is mounted to the crank assembly frame in the described embodiment of the invention;

FIG. 3 is a plan view of a tensioner attached to the crank assembly of this invention;

DETAILED DESCRIPTION OF THE INVENTION

Figure 1:
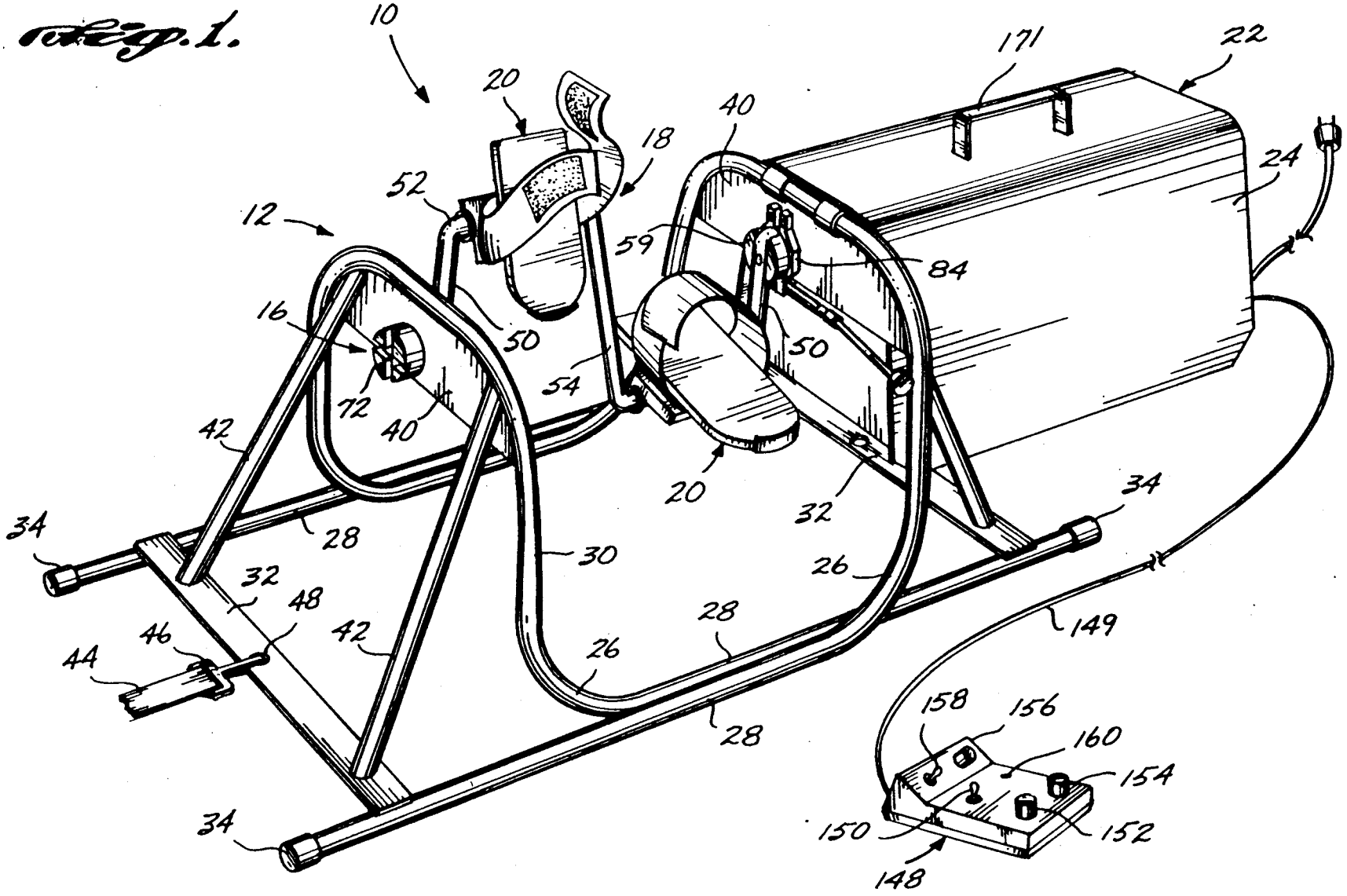
FIG. 1 is a perspective view of the exercise device of this invention.

FIG. 1 depicts an exercise device 10 constructed in accordance with this invention comprising a crank assembly 12 including a frame 16 and a crankshaft 18 rotatably mounted to the frame. A pair of shoe plates 20 are rotatably mounted to diametrically opposite locations on the crankshaft 18 to allow an individual to manually rotate the crankshaft with his legs. The exercise device 10 also includes a motor unit 22 having a housing 24 that is selectively suspended from the crank assembly frame 16 adjacent the crankshaft 18. The motor unit 22 is attached to the crank assembly 12 to provide power for rotating the crankshaft 18 for when an individual would benefit from mechanically assisted exercise.

The crank assembly frame 16 is formed out of two identical, tube-shaped frame members 26. Each frame member 26 has a pair of parallel, spaced-apart, horizontally extending cross beams 28 that rest on the surface upon which the exercise device 10 is placed. Integral with each pair of cross beams 28 and connected therebetween is a vertically oriented, inverted U-shaped support frame 30. The frame members 26 are placed together such that on one side of the crank assembly frame 16, a cross beam 28 of a first frame member is outside a cross beam of a second frame member, and on the opposite side of the crank assembly frame 16, the cross beam of the first frame member is inside the cross beam of the second frame member. The frame members 26 are further arranged so that the cross beams 28 only partially overlap and the cross beams of each frame member extend beyond the support frame 30 of the opposite frame member. A horizontally oriented spacer bar 32 is attached to the opposed cross beams 28 of each frame member between the open ends of the cross beams and the support frame 30 of the opposite frame member. Protective caps 34 cover the open ends of each cross beam 28.

A vertically oriented end plate 40 is attached to the top of each support frame 30 between the portions of the frame member 26 that comprise the support frame. The crankshaft 18 is rotatably attached at either end to the opposed end plates 40. Lateral support for each support frame 30 and end plate 40 is provided by a pair of tube-shaped braces 42 that extend diagonally between the end plate 40 and the adjacent spacer bar 32. Each brace 42 extends from a position on the end plate 40 adjacent the vertical section of the support frame 30 to a position on the lateral perimeter of the spacer bar 32 near the adjacent cross beam 28.

The crank assembly 12 is secured to a bed or support structure by a pair of adjustable straps 44, one partially shown. Each strap 44 is attached to a separate spacer bar 32 by a hook 46 on the strap that is inserted into a hole 48 formed in the center of the spacer bar. The straps 44 are each provided with another hook or fastening means (not illustrated) for attachment to a mattress frame or other immobile structure.

The crankshaft 18 is generally an S-shaped piece of tubing that is mounted horizontally end-to-end to the frame end plates 40. The crankshaft 18 includes two vertically oriented solid end pieces 50 that are rotatably attached to the separate end plates 40. The crankshaft 18 further includes a pair of horizontally oriented grip sections 52, each of which is attached at one end to the free end of an end piece 50, and a cross bar 54 attached between the free ends of the grip sections 52. The grip sections 52 and cross bar 54 are typically formed out of a single tubular section to which the end pieces 50 are attached.

As depicted in detail in FIG. 2, an axle 56 is used to rotatably secure each crankshaft end section 50 to the adjacent crank assembly frame end plate 40. Each axle 56 is formed of aluminum or other metal and includes a large-diameter cylindrical base 58 to which the crankshaft end section 50 is secured. The axle base 58 is formed with a diametrically extending cut 59 (FIG. 1) in which the end of the adjacent crankshaft end piece 58 is lodged. A threaded fastener 60 inserted into concentric threaded bores 61 and 62 in the crankshaft end piece 50 and axle base 58, respectively, secures the crankshaft 18 to the axle 56.

Integral and concentric with the axle base 58 is a cylindrical shaft 64 which extends through a shaft hole 66 formed in the end plate 40. A bushing 68 bolted or otherwise secured to the outside of end plate 40 adjacent the shaft hole 66 has a collar 70 that extends around the hole between the axle shaft and the end plate. The bushing 68 is formed of nylon or similar low-coefficient of friction material so as to maximize the freedom of rotation of the crankshaft 18 around the frame 16.

A coupler 72 is mounted over the free end of each axle shaft 64 for transferring power to the crankshaft 18. Each coupler 72 is generally cylindrical and has a center bore 73 into which the head of the shaft is nested. The coupler 72 is secured to the axle shaft 64 by a set of dowel pins 74, one shown in phantom, that extend laterally, but not diametrically, through the shaft and coupler. The coupler 72 has a face 80 designed to interlock with a complementary coupler 82 (FIG. 7) on the motor unit 22, as will be described hereafter.

The crank assembly 12 is also provided with a tensioner 84, illustrated in FIG. 3, for applying an adjustable resistive force for when the exercise device 10 is to be used manually. The tensioner 84 includes a pair of opposed brake shoes 86, each hingedly secured by a threaded fastener 87 to one of the end plates 40 above the shaft hole 66. The brake shoes 86 have opposed arcuate faces 88 with curvatures that conform to the diameter of the adjacent axle base 58. Leather pads 89 or material with similar mechanically resistive qualities are attached to each arcuate face 88. A coil spring 90 extending between the free ends of each brake shoe 86 beneath the axle base 58 normally urges the brake shoes from each other and away from the axle base. An adjustable screw 92 which extends through threaded bores 94 in the brake shoe 86 free ends and through the coil spring 90 urges the brake shoes together so that a resistive force can be adjustably applied to the axle base 58 and the crankshaft 18. A knob-and-shaft assembly 96 is provided for setting the screw 92. The knob-and-shaft assembly 96 is attached to the head of the screw 92 by a universal joint 98 to facilitate adjustment of the tensioner by either the person using the device 10 or the person controlling its use.

Figure 4C:
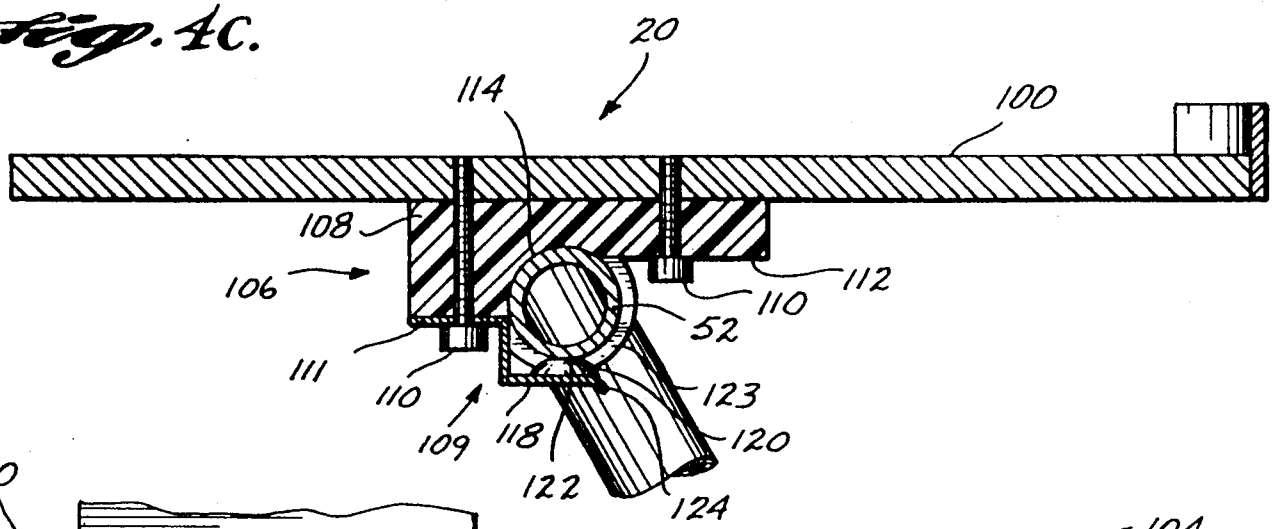
FIGS. 4*a*, 4*b*, and 4*c* are respectively cross section, bottom and perspective views of the features of the shoe plates including the bearing assembly used to attach the shoe plate to the crankshaft of the frame assembly.
Figure 4B:
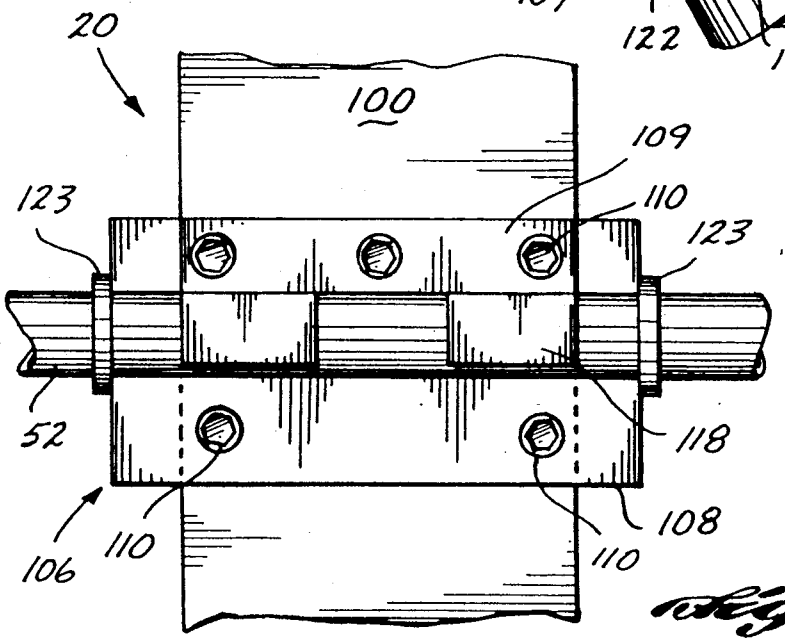
Figure 4A:
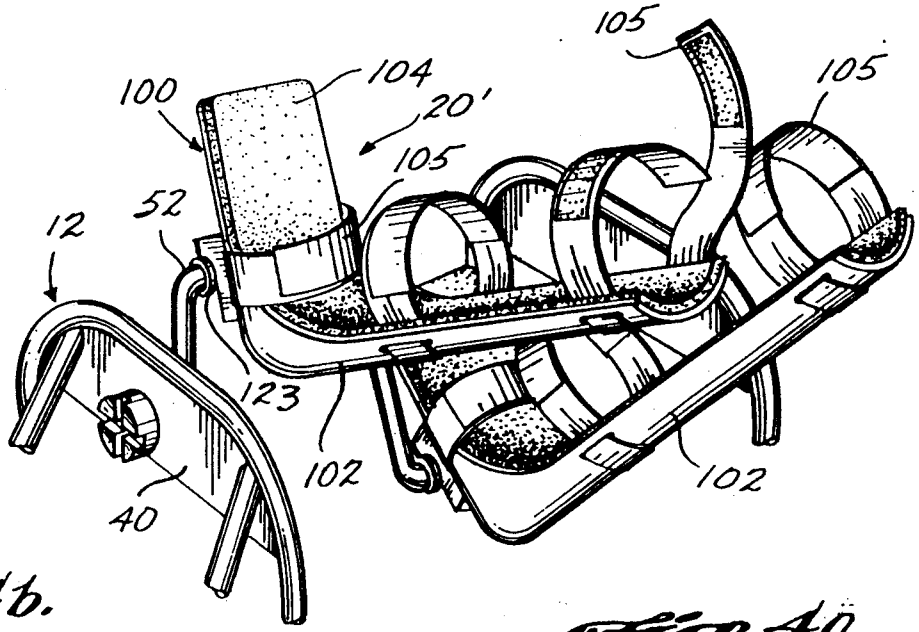

Each shoe plate 20 as depicted in FIGS. 4*a–c*, has a foot pedal 100 that is rotatably attached to the crankshaft grip section 52. As shown in FIG. 4*a*, the shoe plates 20 may be provided with semicircular calf supports 102 that extend integrally from the heels of the foot pedals 100. The shoe plate 20 is formed from either metal or a reinforced plastic and is provided with foam padding 104 on the foot pedal 100 and calf support 102 for the comfort of individuals using the device 10. Velcro straps 105 are provided on the foot pedals 100 and calf supports 102 for when it is necessary to secure an individual's feet and legs to the shoe plates 20.

The shoe plates 20 are rotatably and releasably mounted to the crankshaft 18 by bearing assemblies 106 described with reference to FIGS. 4*b* and 4*c*. Each bearing assembly 106 includes a plate 108 attached to the underside of the foot pedal 100 and a spring clamp 109 attached to the plate that holds the plate to the crankshaft grip section 52. The plate 108 is formed out of nylon or other material with a relatively low coefficient of friction and is mounted to the foot pedal 100 opposite where the arch of the individual's foot is normally placed. Threaded fasteners 110 are used to secure the bearing assembly 106 to the foot pedal 100. The plate 108 surface opposite the surface attached to the foot pedal has a first step 111 adjacent the pedal "toe" section that is higher than a second step 112 adjacent the pedal "arch" section. Between the first and second steps is an arcuate groove 114 that the crankshaft grip section 52 abuts.

The clamp 109 is formed from a section of spring steel or other resilient metal and is step-shaped. The clamp 109 has a first step 116 that is bolted or otherwise secured to the plate first step 111. The clamp 109 has a pair of coplanar, spaced apart second steps 118 located adjacent the crankshaft grip section opposite the portion of the crankshaft grip section 52 that abuts the plate arcuate groove 114. Wear strips 120 are attached to the second steps 118 adjacent the crankshaft grip section 52. Each wear strip 120 has an arcuate face 122 that abuts the crankshaft grip section 52 and is formed of nylon or other material with a low coefficient of friction. The resilient strength of the clamp 109 normally holds the bearing plate and shoe plate 20 to the crankshaft grip section. Since the bearing assembly plate 108 and wear strips 120 have relatively low coefficients of friction, the shoe plate 20, though clamped to the crankshaft 18, is able to freely rotate about the crankshaft grip section 52. The crankshaft grip section 52 is provided with a pair of annular external ribs 123, on either side of the bearing assembly 106 that limit the lateral movement of the bearing assembly 106 and shoe plate 20.

The shoe plates 20 are replaced with handgrips 196 (FIG. 9) on other limb support units by snap releasing the clamp 109. The clamp 109 is provided with outwardly extending tabs 124 integral with the ends of the second steps 118 that serve as hand-holds for releasing the clamp.

Figure 5:
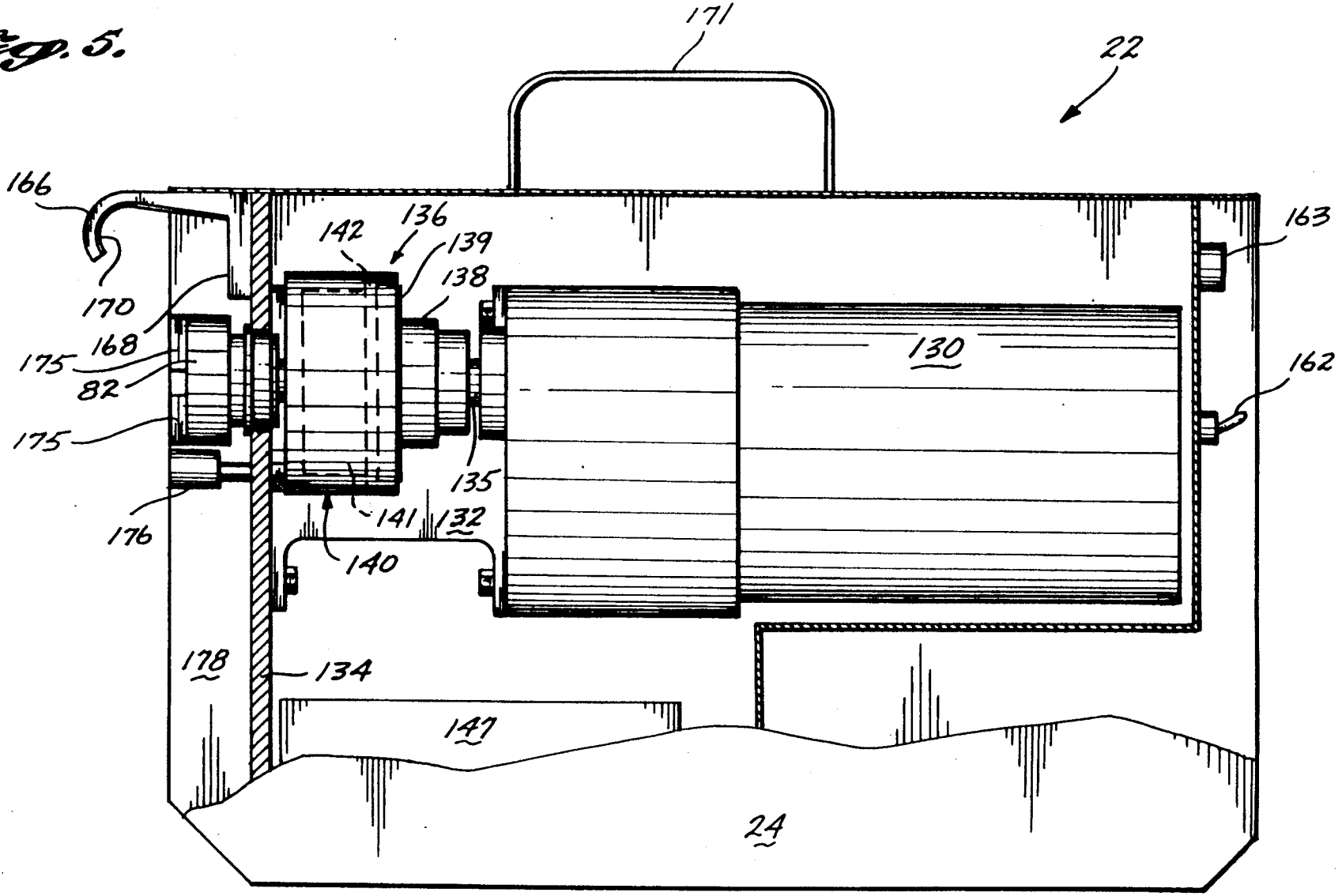
FIG. 5 is a side cut-away view of the motor unit of the described embodiment of the invention.
Figure 6:
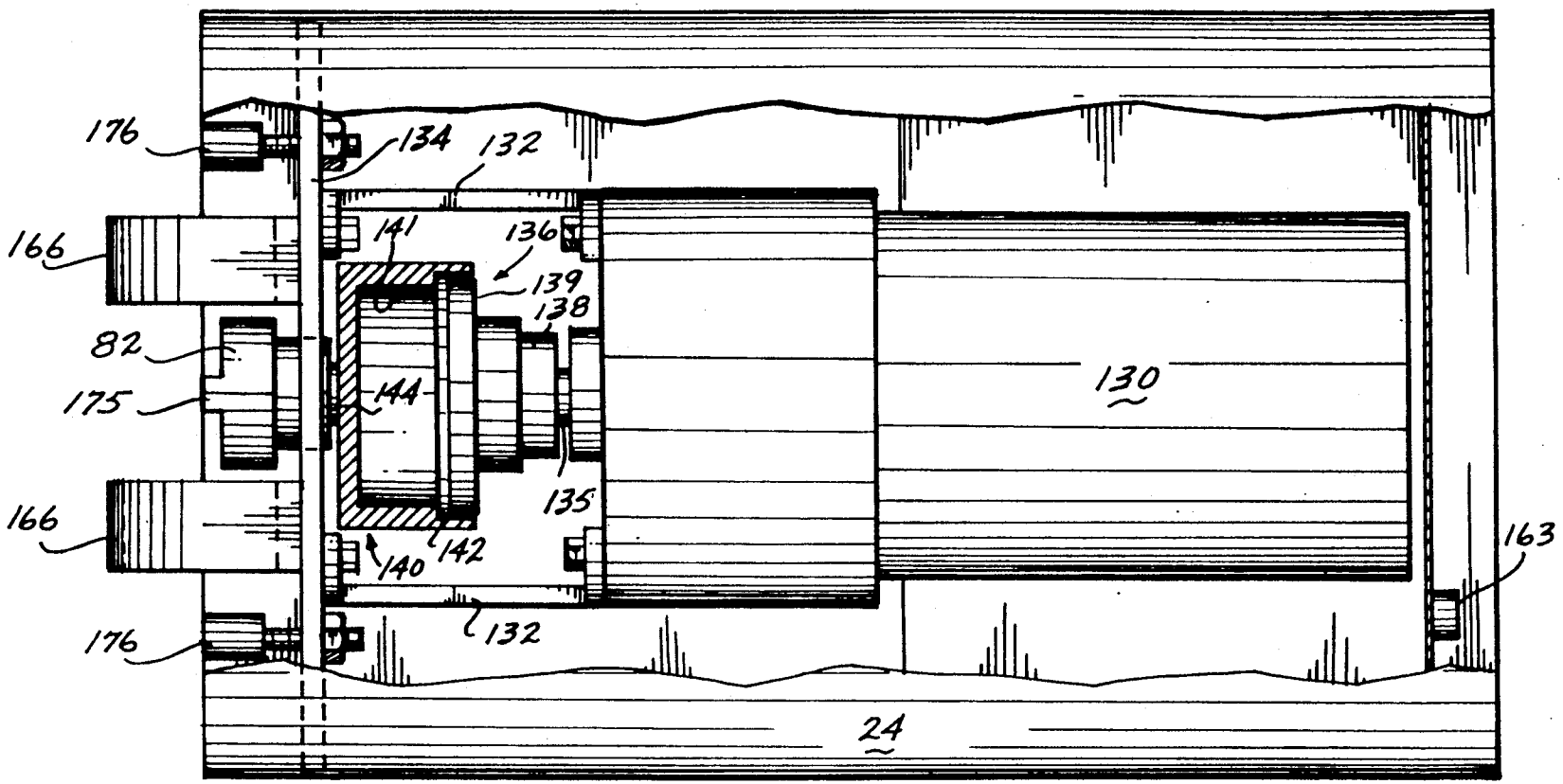
FIG. 6 is a top view of the motor unit.

The motor unit 22 includes a drive motor 130, as depicted in FIGS. 5 and 6, for mechanically rotating the crankshaft 18 (FIG. 1). The drive motor 130 is an electrically powered motor capable of generating ¼ horsepower at 60 RPM. A suitable drive motor is a Boldine No. 42D5BEPM-E3. The drive motor 130 is secured inside the motor housing to a pair of bracket supports 132. The bracket supports 132 are each secured to the top of a face plate 134 that forms the front of the motor housing 24.

Power is transferred from a motor drive shaft 135 to the motor coupler 82 through a clutch assembly 136 that prevents power transfer when the crankshaft 18 is stopped from rotating. The clutch assembly 136 includes a torque limiter 138 with a rotating plate 139. Adjacent the rotating plate 139 is a clutch piece 140 that is rotatably mounted to the motor housing face plate 134. The clutch piece has a cylindrical body 141 with a stepped open end 142 the torque limited rotating plate 139 normally abuts. Concentric and integral with the body 141 is a cylindrical shaft 144 that extends through a hole 145 in the motor housing face plate 134. The motor coupler 82 extends through the hole 145 and is secured over the clutch housing shaft 144. A bushing, not illustrated, may be located around the hole 145 to provide a reduced-friction interface between the housing face plate 134 and the coupler 82.

When the exercise device 10 is mechanically powered and the crankshaft 18 is rotating freely, the torque limiter rotating plate 139 abuts the inside of the clutch piece cylindrical body stepped open end 142 and power is transferred to rotate the crankshaft. Should the crankshaft 18 be blocked, the torque limiter 138 senses an increase in attempted applied rotational power beyond the set limit, and retracts the rotating disc 139 away from the clutch unit cylindrical body 141. This stops the transfer of power and the rotation of the crankshaft 18. Thus should an individual's limbs inadvertently be caught in the crankshaft 18, the clutch assembly 136 prevents further rotation of the crankshaft.

An ideal torque limiter 138 to be used with the clutch assembly 136 is the Morse torque limiter No. 250A-1. The torque limiter 138 is set to transfer a maximum 120 in/lbs of torque before stopping power transfer.

The drive motor 130 is controlled by a controller 147 that is secured to the base of the motor housing 24. The controller 147 controls both the RPMs of the motor and the energy supplied to overcome any resistive force. A suitable controller 147 is a Minarik speed controller No. 21051C. The controller 147 senses the power applied by the drive motor 130 by monitoring the current drawn by the drive motor. The controller 147 is also able to control the amount of time the drive motor is used to rotate the crankshaft 18.

User/therapist control of the motor unit 22 is through a remote hand controller 148 connected to the motor controller 147 by a flexible cable 149, as illustrated in FIG. 1. The hand controller 148 has an on/off switch 150, an RPM adjust knob 152, a power adjust knob 154, a timer set knob 156 and a timer on switch 158. The hand controller 148 also has a motor on indicator light 160. The direction of rotation of the drive motor 130 and crankshaft 18 (i.e., clockwise or counterclockwise) is controlled by a rotation set switch 162 attached to the motor housing 24 and connected to the motor controller 147 (FIG. 5). The motor unit 22 is also provide with a circuit breaker 163 to prevent excess current from being applied to the drive motor 130 and controller 147. The circuit breaker 163 is mounted to the outside of the motor housing 24.

The motor unit 22 is suspended from the crank assembly frame 16 by a pair of brackets 166. The brackets 166 are generally J-shaped and are mounted to the top of the housing face plate 134 above and on either side of the motor coupler 82. The brackets 166 are mounted horizontally so that the open-hook ends of the brackets are directed downward. Flanges 168 are integrally attached to the ends of brackets 166 opposite the hook sections to facilitate securing the brackets 166 to the housing face plate by threaded fasteners (not illustrated). The inside curved surfaces of the hook sections of the brackets 166 are covered with a padding 170 to prevent the brackets from scratching the crank assembly frame 16. A handle 171 is attached to the top of the motor housing 24 to facilitate the installation, removal and transport of the motor unit 22.

Figure 7:
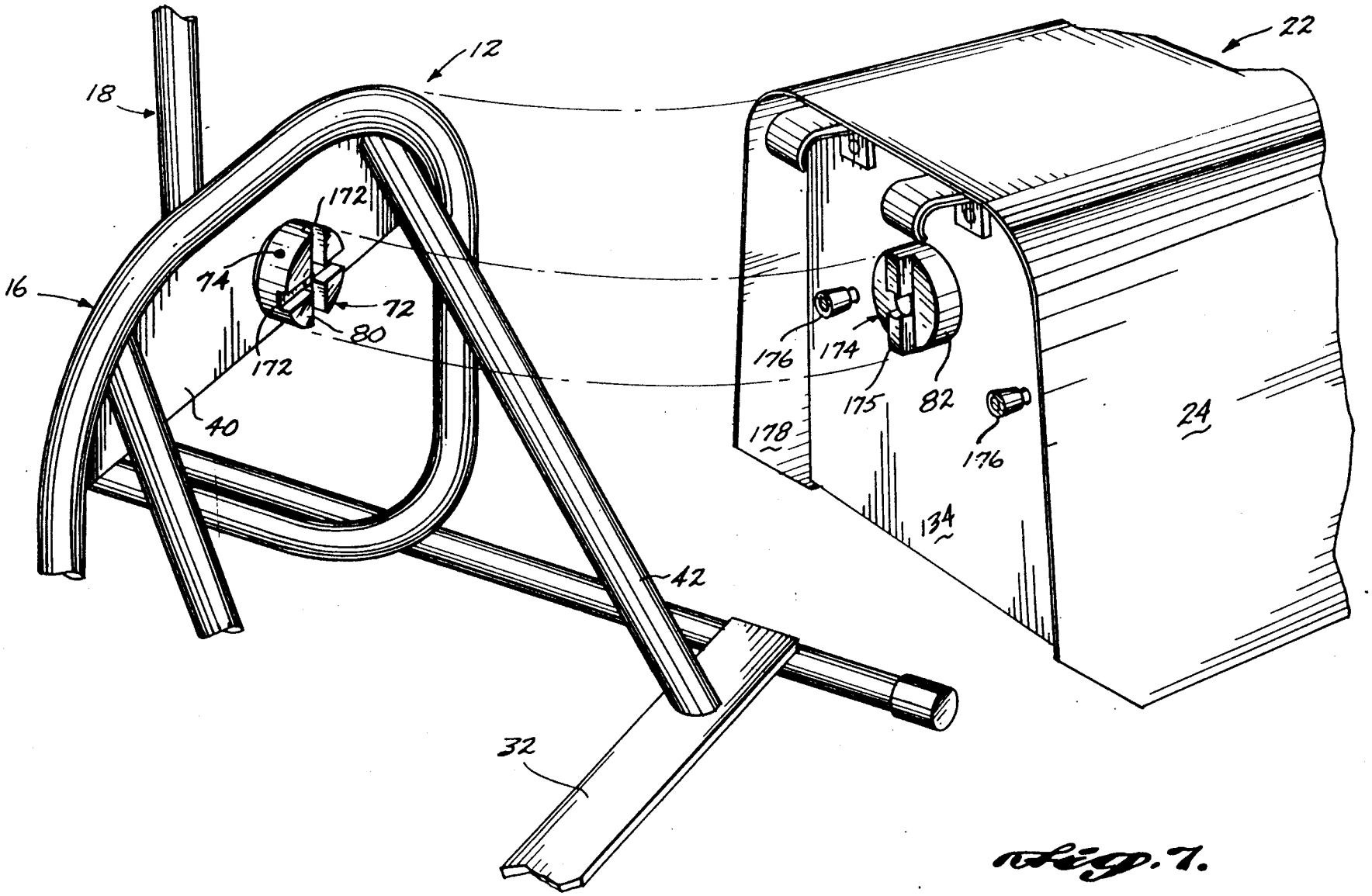
FIG. 7 is a perspective view that depicts the interlocking faces of the crank coupler and motor coupler of the described embodiment of the invention.

As depicted in FIG. 7, the crank coupler 72 and motor coupler 82 are arranged to interlock so that power can be transferred from the motor unit 22 to the crankshaft 18. The crank coupler 72 has a face 80 with two diametrically extending rectangular slots 172 that are perpendicular to each other. The motor coupler 82 has a face 174 with a pair of longitudinally aligned driver studs 175. The driver studs 175 have widths slightly less than the width of the slots 172 in the crank coupler face 80. After the motor unit 22 is suspended from the crank assembly frame 16, the couplers 72 and 82 are interlocked by rotating the crankshaft 18 until the motor coupler driver studs 175 slip into one of the crank coupler slots 172. The downwardly oriented weight of the motor unit 22 biases the motor coupler driver studs 175 in the crank coupler slot 172 so that when the drive motor 130 is actuated, the crankshaft 18 will rotate.

To prevent the motor coupler 82 from imposing excessive force on the crank coupler 72, the motor housing 24 is provided with a pair of adjustable-length feet 176 (FIG. 5) that extend vertically outward from the motor housing face plate 134. The feet 176 abut the adjacent end plate 40 so as to limit the force of the motor coupler 82 against the crank coupler 72.

The motor housing 24 is provided with a flange 178 around the face plate 134 that extends around the crank coupler-motor coupler interface. The flange 178, in combination with the adjacent end plate 40, prevents hands, legs, articles of clothing and the like from coming in contact with the couplers 72 and 82.

Figure 8:
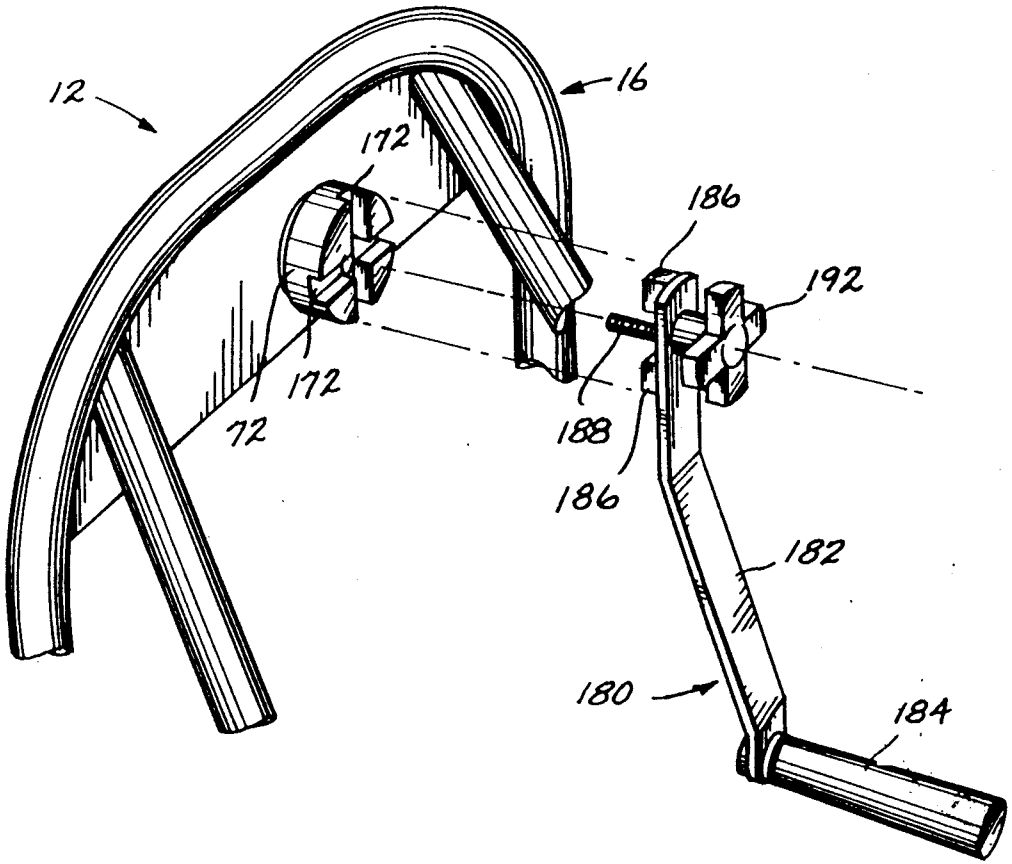
FIG. 8 depicts a hand crank that may be used to rotate the crankshaft of the exercise device of this invention.

The crankshaft 18 may also be rotated manually with a hand crank 180 illustrated in FIG. 8. The hand crank includes a metal shaft 182 that has a pair of angular offsets so that it is spaced from the crank assembly frame 16 and can freely rotate. A handle 184 is rotatably attached to the end of the shaft 182 spaced away from the crank assembly frame 16. Two longitudinally aligned, spaced apart driver studs 186 are integrally attached to the other end of shaft 182. The driver studs 186 are dimensioned to fit within one of the slots 172 on the crank coupler face 80. The hand crank 180 is secured to one of the crank couplers by a threaded fastener 188 that extends outwards between the driver studs 186. The threaded fastener 188 is coupled into a threaded bore 190 in the crankshaft axle shaft 64 (FIG. 2). A knob 192 is attached to the head of the threaded fastener 188 to facilitate the attachment and removal of the hand crank 180.

Figure 9:
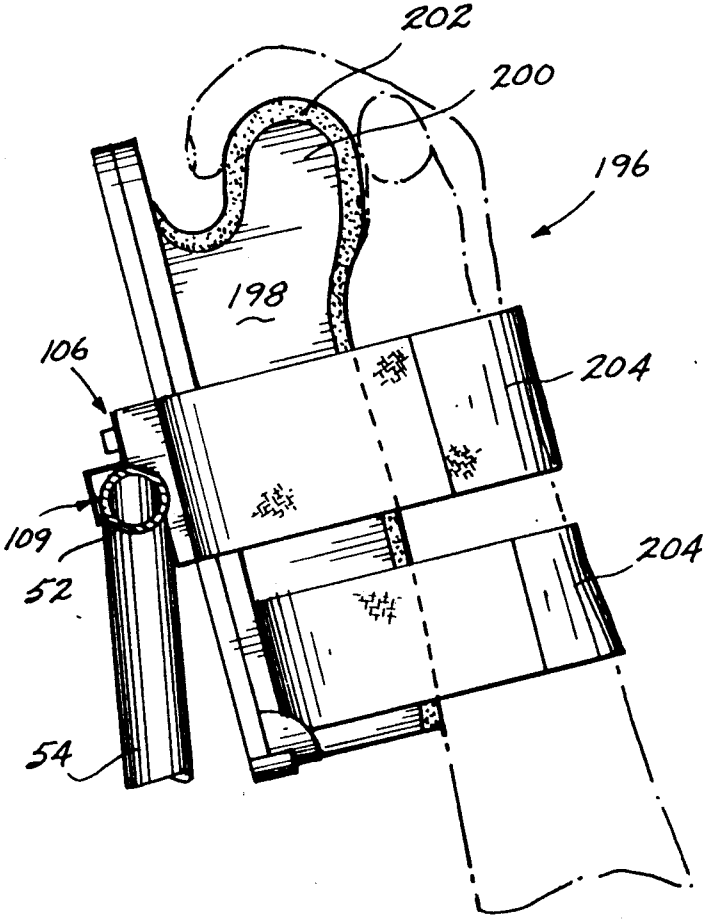
FIG. 9 depicts a handgrip that may be alternatively attached to the exercise device of this invention.

A pair of handgrips 196, one depicted in FIG. 9, can alternatively be attached to the crankshaft 18 for exercising an individual's arms. Each handgrip 196 includes a wrist-arm rest 198 that is attached to a bearing assembly 106 for attaching the handgrip to the crankshaft 18. Integral with the wrist-arm rest 198 is a finger grip 200 with a curved surface dimensioned so that it can be grasped by an individual's fingers. Foam padding 202 is provided on the surfaces of the wrist-arm rest 198 and the finger grip 200 for the comfort of individuals using the handgrip 196. Velcro strips 204 are provided with the handgrip 196 for securing an individual's hands and lower arms to the grip.

The exercise device 10 of this invention allows an individual to exercise his arms or legs with or without mechanical assistance. When manual exercise is desired, the crank assembly 12 can be used alone to therapeutically work an individual's limbs. The tensioner 84 can be adjusted so that the individual must work against a resistive force and be made to stress his muscles.

Alternatively, the exercise device 10 can be used to provide mechanically assisted exercise by suspending the motor unit 22 from the crank assembly 12 and interlocking the crank and motor couplers 72 and 82. Since the motor unit 22 is supported from the crank frame by the two brackets 166, and the couplers 72 and 82 automatically interlock when the crankshaft 18 is turned, the units can be connected by even mechanically disinclined individuals with a minimal amount of effort.

Still another feature of the exercise device 10 is that the amount of power applied from the motor unit 22 is highly regulated. In normal circumstances, the device user or therapist can set the amount of power the drive motor applies. Thus, an individual with stiff limbs can be subjected to an appropriate amount of mechanical force that is desired to overcome the stiffness. The clutch assembly 136 prevents power from being applied to the crankshaft 18 in the event the crankshaft is blocked from turning, as may happen if an individual's limbs become caught in the crank assembly 12.

The exercise device 10 of this invention is also very portable and convenient to set up anywhere. Since the device 10 includes two separate units, the crank assembly 12 and the motor unit 22, it can readily be moved from location to location. The stable nature of the crank assembly frame 16 makes it possible to set up this device 10 on a floor, a bed, or any other surface where an individual would find its use most convenient and comfortable. Both ends of the crankshaft 18 are provided with a crank coupler 72. This further contributes to the convenience of the device 10 since it makes it possible to suspend the motor unit 22 from either side of the crank assembly 12.

This exercise device 10 is well suited for bedridden individuals, since minimal effort is involved in lifting the crank assembly 12 and motor unit 22 separately to bed level and then assembling them together. Also, the motor unit 22 of this device 10 is suspended above the surface on which the crank assembly 12 is placed. This reduces the effort required to separate the crank assembly 12 and motor unit 22 when it is time to disassemble the exercise device 10. When the exercise device 10 is bed-mounted, the straps 44 provide a convenient means for securing the device on top of a mattress.

Still another advantage of the motor unit 22 being above the surface on which the device 10 rests is that the motor unit does not contact the bedding material. This minimizes the dirtying of the bedding as would happen if there were contact with the dust and dirt that inevitably finds its way to the surface of the motor housing 24.

The hand crank 180 makes it possible to provide individuals with mechanically assisted exercise who require individual assistance in working their limbs. Still another feature of this invention is that either the handgrips 196 or shoe plates 20 can be readily attached to the crankshaft so that either an individual's arms or legs can be exercised as may be desired.

The foregoing detailed description has been limited to a specific embodiment of the invention. It will be apparent, however, that variations and modifications can be made to this invention with the attainment of some or all of the advantages thereof. For example, the described drive motor, torque limiter and motor controller are exemplary, and alternative units may be used as desired. Similarly, other motor and crankshaft releasable interconnect couplings may be readily substituted for the disclosed couplings.

Crankshafts, handgrips, shoe plates and bearing assemblies other than those disclosed may be used in alternative embodiments of this invention. For example, it may be desirable to provide different sized crankshafts 18, with each crankshaft having a different grip-section-to-grip sectioon separations. This would make it possible for an individual to be subjected to a first large radius of movements when he is exercising his legs and a second, smaller radius of movement when he is exercising his arms. The threaded fasteners 60 used to secure the crankshaft 18 to the axle 56 make it possible to readily switch crankshafts as may be required. Further, it should be understood that the disclosed bearing assembly 106 is also exemplary and other bearing assemblies may be used to rotatably and releasably secure the handgrips 196 or shoe plates 20 to the crankshaft 18.

Therefore, it is the object of the appended claims to cover all such variations as come within the true spirit and scope of the invention.

The embodiments of the invention in which an exclusive property or privilege is claimed are defined as follows:

1. An exercise device including:

a crank assembly comprising a frame, a crankshaft attached for rotation to said frame, at least one gripping member for receiving a limb attached to said crankshaft, and a crankshaft coupler attached to an end of said crankshaft;

a motor unit including a drive motor disposed in a housing and a motor coupler adapted to interlock with said crank coupler rotatably attached to said drive motor and located outside of said motor unit housing; and a coupling assembly located partially on said crank assembly above said crankshaft coupler and partially on said motor unit above said motor coupler for selectively suspending said motor unit to said crank assembly frame above said couplers so that said motor coupler abuts against and interlocks with said crankshaft coupler.

2. The exercise device of claim 1, wherein said coupling assembly includes at least one bracket attached to said motor unit housing above said motor coupler for selectively suspending said motor unit from said crank assembly frame.

3. The exercise device of claim 1 wherein:

said crank assembly frame includes a pair of opposed, vertically oriented support frames extending upward from a surface on which said frame is located, and said crankshaft is rotatably secured at each end between said support frame;

a crank coupler is attached to each end of said crankshaft next to an adjacent said support frame; and said coupling assembly is located on both said support frames above said crankshaft coupler associated therewith so that said motor unit can be coupled to either end of said crankshaft.

4. The exercise device of claim 3, wherein said coupling assembly includes at least one bracket attached to said motor unit housing above said motor coupler for selectively suspending said motor unit from either said support frame.

5. The exercise device of claim 1 wherein said crank assembly frame includes a pair of opposed, vertically oriented support frames extending upwards from a surface on which said frame is located, said crankshaft rotatably secured at each end between said support frames, and at least one said crank assembly support frame including an end plate to which said crankshaft end having said crankshaft coupler is rotatably mounted such that said crankshaft coupler is located adjacent to said end plate opposite said crankshaft, and said coupling assembly is located on said crank assembly and said motor unit so that said motor unit is suspended from said crank assembly adjacent to said end plate.

6. The exercise device of claim 5, wherein said motor unit housing includes a flange extending around said motor coupling and at least partially around said crankshaft coupling whereby, when said motor unit is suspended from said crank assembly said motor coupling and crankshaft coupling interface is substantially concealed by said motor unit housing flange and said crank assembly support frame end plate.

7. The exercise device of claim 6 wherein said coupling means includes at least one bracket mounted to said motor unit housing above said motor coupler for suspending said motor unit from said crank assembly support frame.

8. The exercise device of claim 6 further including a stop member extending from said motor unit housing adjacent said motor coupler and dimensioned to abut said crank assembly end plate.

9. The exercise device of claim 7 further including a stop member attached to said motor unit housing adjacent said motor coupler to abut said crank assembly end plate.

10. The exercise device of claim 7 further including a tensioner attached to said crank assembly for applying a resistive force against said crankshaft.

11. The exercise device of claim 7, wherein said limb placement gripping member is rotatably and releasably attached to said crankshaft assembly.

12. The exercise device of claim 11 wherein said limb placement gripping member is a handgrip adapted for placement of a hand thereon.

13. The exercise device of claim 11 wherein said limb placement gripping member is a shoe plate adapted for placement of a foot thereon.

14. The exercise device of claim 7 wherein said crankshaft includes two limb placement gripping members each said gripping member being rotatably and releasably attached to said crankshaft.

15. The exercise device of claim 14 wherein each said limb placement gripping member is a shoe plate adapted for placement of a foot thereon.

16. The exercise device of claim 14 wherein each said limb placement member is a handgrip adapted for placement of a hand thereon.

17. An exercise device comprising:

a crank assembly comprising a frame including a pair of opposed vertically oriented support frames, an end plate attached to each said support frame, a crankshaft attached for rotation between said end plates, and a crank coupler attached to each end of said crankshaft adjacent said end plates and on opposite side of said end plate to said crankshaft, and a gripping member rotatably attached to said crankshaft;

a motor unit selectively attachable to said crank assembly said motor unit including a drive motor and a motor coupler rotatably attached to said drive motor adapted to interlock with said crankshaft couplers and at least one bracket on said motor unit for securing motor unit to either said crank assembly support frame so that said motor unit can be coupled to either said crankshaft coupler.

18. The exercise device of claim 17 wherein said motor unit includes a flange extending around said motor unit coupling and at least partially around said interlocking crankshaft coupling.

19. The exercise device of claim 17, further including a tensioner attached to said crank assembly for adjustably applying a resistive force against said crankshaft.

20. The exercise device of claim 17, wherein said limb placement gripping member is rotatably and releasably attached to said crankshaft assembly.

21. The exercise device of claim 20 wherein said limb placement gripping member is a handgrip adapted for placement of the hand thereon.

22. The exercise device of claim 21 wherein said limb placement gripping member is a shoe plate adapted for placement of a foot thereon.

23. The exercise device of claim 17 wherein said crankshaft includes two limb placement gripping members each said gripping member being rotatably and releasably attached to said crankshaft.

24. The exercise device of claim 23 wherein each said limb placement gripping member is a shoe plate adapted for placement of a foot thereon.

25. The exercise device of claim 23 wherein each said limb placement member is a handgrip adapted for placement of the hand thereon.

* * * * *